US006772902B1

(12) United States Patent
White

(10) Patent No.: US 6,772,902 B1
(45) Date of Patent: Aug. 10, 2004

(54) ONE-PIECE MOLDED CHILD-PROOF CONTAINER

(75) Inventor: Colin White, 9 Ridgeway Dr., Warren, RI (US) 02885

(73) Assignee: Colin White, Warren, RI (US)

( * ) Notice: Subject to any disclaimer, the term of this patent is extended or adjusted under 35 U.S.C. 154(b) by 0 days.

(21) Appl. No.: 10/600,739

(22) Filed: Jun. 20, 2003

(51) Int. Cl.[7] ..... B65D 43/16
(52) U.S. Cl. ..... 220/283; 215/201; 215/224
(58) Field of Search ..... 220/283, 281, 220/831–834, 837, 810, 324, 800, 801, 838–842; 215/201, 202, 254, 230, 231, 224

(56) References Cited

U.S. PATENT DOCUMENTS

| | | | | | |
|---|---|---|---|---|---|
| 3,442,414 | A | * | 5/1969 | Pelli | 220/324 |
| 3,865,267 | A | * | 2/1975 | Morris | 215/206 |
| 4,170,315 | A | * | 10/1979 | Dubach et al. | 220/281 |
| 4,449,638 | A | * | 5/1984 | Davis | 215/211 |
| 4,746,008 | A | * | 5/1988 | Heverly et al. | 206/1.5 |
| 4,974,735 | A | * | 12/1990 | Newell et al. | 215/253 |
| 4,998,988 | A | * | 3/1991 | Zinnbauer | 215/230 |
| 5,083,671 | A | * | 1/1992 | Hayes | 215/245 |
| 5,270,011 | A | * | 12/1993 | Altherr | 422/102 |
| 5,484,070 | A | * | 1/1996 | Graham | 215/223 |
| 5,683,016 | A | * | 11/1997 | Santagiuliana | 222/153.14 |
| 6,257,441 | B1 | * | 7/2001 | Maley | 220/840 |
| 6,662,454 | B2 | * | 12/2003 | Harrold | 30/326 |

FOREIGN PATENT DOCUMENTS

| | | | | |
|---|---|---|---|---|
| GB | 2035274 | * | 6/1990 | 220/283 |

* cited by examiner

*Primary Examiner*—Lien Ngo
(74) *Attorney, Agent, or Firm*—Donald W. Meeker

(57) ABSTRACT

A thin-walled child-proof container is formed entirely in one piece in a molding process. The container has a self-engaging child-proof safety closure between the container and its cover. The cover is attached to the container by a living hinge. A self-aligning tapered self-sealing lip is provided between the cover and the container. The child-proof safety closure comprises a hook retainer with a V-shaped bottom point or edge attached to the container and a flexible tab with a mating bottom V-shaped hook attached to the cover. The cover further comprises a visual indicator on an outer surface of the cover, adjacent to the tab. The visual indicator indicates a compression point to be contacted to compress the cover and the visual indicator further indicates a direction in which the tab must be moved to release the V-shaped hook of the tab from the V-shaped point of the hook retainer.

4 Claims, 5 Drawing Sheets

ONE-PIECE MOLDED CHILD-PROOF CONTAINER

BACKGROUND OF THE INVENTION

1. Field of the Invention

The present invention relates to containers and in particular to a thin-walled container formed entirely in one piece in a molding process and having a self-aligning and self-engaging child-proof safety closure between the container and the cover attached by a living hinge.

2. Description of the Prior Art

Law now mandates providing child-proof openings on containers, such as pill bottles. Any such feature on a container would normally add to the cost of manufacturing the container, normally requiring specially made caps. In any manufacturing and selling environment, there is always a need to keep costs to a minimum to remain competitive and still make a profit. Injection molding of plastic containers and other objects is known to be inexpensive and efficient with a high production rate possible.

Prior art devices have not adequately solved this problem to cut the manufacturing costs substantially in making a child-proof bottle, which meets government requirements for child safety.

U.S. Pat. No. 4,170,315, issued Oct. 09, 1979 to Dubach, et al., describes a closure of synthetic resin material that has a cap connected to a base which fits onto the container by a hinge joint which may be of the flexible film type and can be molded unitarily with the base and cap. On the opposite side of the cap from the hinge, there is provided a lever which has a pressing plate and a hook, the latter being engageable with a detent on the base so that entered pressure on the plate allows the cap to swing upwardly. To open the cover, one has to push down the top of the cover, and then push out the locking tab while pushing up the cover. This is not an intuitive maneuver and requires some dexterity and effort to open.

U.S. Pat. No. 6,257,441, issued Jul. 10, 2001 to Maley, puts forth a child safe mop bucket assembly that prevents a child from accessing the contents of the bucket yet enables a mop to extend out of the bucket. The bucket assembly includes a fluid impermeable container having an open end and a lid element sized to cover that open end. The lid element contains an opening that enables a mop handle to extend out through the lid element if a mop is left within the container. The lid element also includes at least one locking pawl that engages the container when the lid element is closed over the open end of the container. The locking pawl is configured to be easily opened by an adult, yet cannot be opened by a small child. As a result, the lid element prevents a small child from accessing the contents of the bucket assembly even when a mop is left within the bucket assembly, thereby protecting the child from harm and the risk of drowning.

U.S. Pat. No. 4,809,874, issued Mar. 07, 1989 and U.S. Pat. No. 4,787,526, issued Nov. 29, 1988, both to Pehr, disclose a vial or other container including a hinged closure member having a latch for securing the closure member in a closed position. The latch includes a "child resistant" configuration wherein it is very difficult for adolescents to open the container and an "easy open" configuration wherein it is relatively simple for persons with limited manual dexterity to open the closure member. The latch includes a bipositional tongue hingedly attached to either the container or closure member. The tongue is hinged to allow for the various configurations and, when in the child-proof configuration, substantially requires use of both hands and a substantial amount of dexterity in order to open the closure member. Various devices are further provided to protect the tongue from manipulation by adolescents and for indicating previous tampering with the container. A hinge on the container connects the closure member. The hinge includes a bar attached to either the container or the closure member and a semi-circular sleeve that rotates about the bar and is attached to the opposite of the container or the closure member.

U.S. Pat. No. 5,979,691, issued Nov. 09, 1999 to Von Holdt, provides a two-piece, connectable article comprising a first piece and a second piece that fit together in a connected position. One of the first and second pieces has a plurality of integral, extending members that have free ends that each defines a latch member. The other of the first and second pieces has a facing wall that defines a plurality of apertures positioned to receive the free ends of the extending members in the connected position. The apertures are sized to cause flexing of the latch members as the latch members are placed through the apertures to assume the connected position. The extending members and facing wall are proportioned to permit the latch members to spring back to an original position in the connected position, to effectively prevent separation of the first and second pieces until at least some of the extending members are broken away.

U.S. Pat. No. 5,356,017, issued Oct. 18, 1994 to Rohr, et al., indicates a child-resistant closure with a base having a deck with a discharge aperture. A lid having a bottom surface for engaging the base is hingedly connected to the base. The base has a resilient locking lever that projects the base deck at a location inwardly of the periphery of the base. The lever defines a shoulder. The lid has a central cover panel defining an aperture inwardly of the periphery of the lid for receiving the lever when the lid is closed. The lid defines a latch surface adjacent the aperture for confronting the base lever shoulder when the lid is closed. The periphery of the lid defines a finger-engaging surface laterally offset relative to the lid aperture, and the finger-engaging surface extends progressively outwardly with increasing distance from the lid bottom surface. The portion of the base that extends from the hinge connection is configured to project peripherally outwardly at least as far as the lid bottoms surface when the lid is closed. The portion of the lid periphery that extends from the hinge connection is free of overhanging peripheral surfaces of sufficient depth to be liftingly engaged by a child's teeth.

What is needed is a child-proof pill bottle that can be manufactured by injection molding in a single piece with a child-proof closure means between a top and the bottle and with an opening procedure that is not accessible for children but yet is intuitive for adults requiring little effort or dexterity once the procedure is understood by the adult.

SUMMARY OF THE INVENTION

An object of the present invention is to provide a thin-walled child-proof pill bottle which can be manufactured by injection molding in a single piece with a child-proof closure means between a top and the bottle thereby keeping manufacturing costs to a minimum and enabling high production rates in high volumes. Another object of the present invention is to provide a simple press and push two step opening process that is easy for adults requiring little effort or dexterity once the opening method is understood and yet not intuitive for young children. To open the cover of the present invention, after pushing down the cover to open, one pushes in the tab, while the cover self releases from the container.

A related object of the present invention is to position the marked press down point in the front of the cap immediately adjacent to the locking tab to provide a mechanical advantage over just pressing down on the middle of the cap, thereby providing greater ease of opening for adults.

One more object of the present invention is in injection molding a living hinge between the cap portion and the bottle portion of the mold for ease of manufacturing and ease of use with the cap always attached and so that the cap and container are self-aligning and the child-proof locking components are self-engaging upon closing and pressing down the cap.

A corollary object of the present invention is to provide a tapered self-engaging and self-sealing lip between the cap and the container to guarantee a tight closure.

A further object of the present invention is injection molding mating interactive press and snap interlocking components in the cap portion and bottle portion, thereby producing a highly effective yet inexpensive pill bottle with a child-proof closure.

In brief, a child-proof container is provided that comprises a container that has an interior storage space and is formed in one piece by a molding process. The container has an upper opening lip that communicates with the interior storage space. The upper opening lip has a hook retainer surface that is connected on an exterior side surface of the opening lip. The hook retainer has an outer face that faces away from the container and an inner face that faces toward the container, both taper relative to the container. The two faces meet in a V-shaped point at a lower end of the hook retainer. The hook retainer is spaced apart from the container and the outer face and the inner face both taper inwardly toward the container from an upper portion to a lower bottom-portion to form a mating V at the bottom.

The child-proof container also comprises a cover that is removably engageable with the opening lip along a flexible tapered engaging surface between the cover and the opening lip. The flexible tapered ridge faces the container to form the flexible tapered engaging surface, the ridge is capable of mating with the opening lip of the container so that the ridge is capable of maintaining a seal with the lip along the flexible tapered engaging surface in both positions. The cover can move toward the container to a compressed position and away from the container to a normally sealed position. The cover is connected to the container by a living hinge, on a side opposite to the hook retainer, and is formed during the molding process. The cover further comprises a flexible tab that protrudes from the side of the cover, which is capable of mating with the hook retainer. The flexible tab has a bottom V-shaped hook so that the flexible tab can contact the hook retainer in the normally sealed position and slide down the hook retainer as the cover is pressed into the container from the normally sealed position to the compressed position with the tab flexing due to the contact with the hook retainer. The V-shaped bottom hook can fit between the hook retainer and the container, facing outwardly toward the hook retainer. The V-shaped hook can snap over and engage the V-shaped bottom point or bottom edge of the hook retainer in the compressed position. The cover is capable of moving back to the normally sealed position, upon engagement of the V-shaped hook of the tab with the V-shaped point of the hook retainer. Release of the cover requires the cover to be in the compressed position and the tab to be moved so that the V-shaped hook is clear of the V-shaped point of the hook retainer and the cover is movable away from the container. The cover further comprises visual indicators on an outer surface of the cover, adjacent to the tab. The visual indicators show a compression point to be contacted to compress the cover, and also a direction indicated by an arrowhead symbol, in which the tab must be moved to release the V-shaped hook of the tab from the V-shaped point of the hook retainer. The visual indicators are formed on the cover in the molding process.

An advantage of the present invention is that it is child-proof.

An added advantage of the present invention is that it provides a mechanical advantage in the opening process, thereby providing greater ease of opening for adults.

One more advantage of the present invention is that the cap and container are self-aligning and the child-proof locking components are self-engaging.

A related advantage of the present invention is that the cap and container are self-sealing.

Another advantage of the present invention is that it is molded in one piece during the manufacturing process.

An additional advantage of the present invention is that it is easy for an adult to use.

One more advantage of the present invention is that it is inexpensive to manufacture.

Yet another advantage of the present invention is that it may be molded from recyclable plastic.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
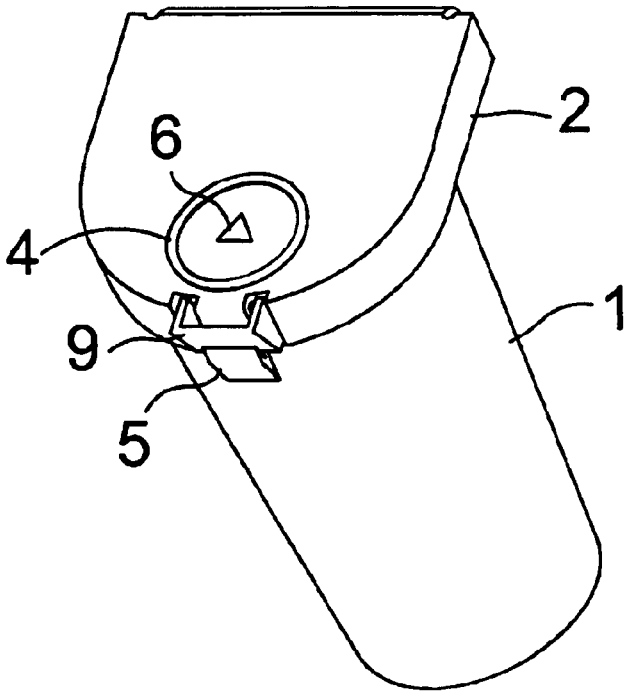
FIG. 1 is a perspective view of the one-piece molded child-proof pill container showing the closed top with a depression area marked with an indication of which direction to push the lock tab for opening the bottle after depressing the top.
Figure 2:
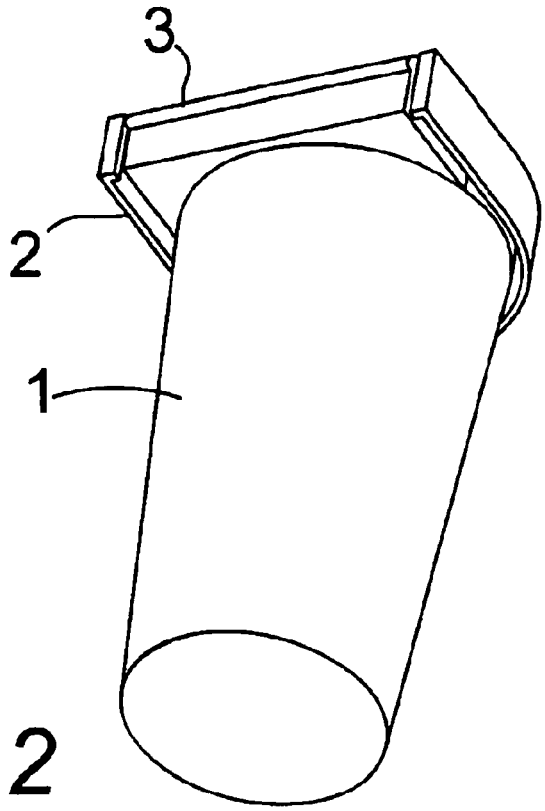
FIG. 2 is a perspective view of the invention of FIG. 1 showing the bottom and back of the bottle with the living hinge and the top of the bottle closed.

In FIGS. 1–9, a thin-walled one-piece child-proof pill bottle is formed in one piece by a molding process. The invention comprises a container 1 which has an upper opening lip 8 that communicates with the interior storage space. The upper opening lip 8 has a hook retainer surface 9 that is connected to the opening lip 8 on an exterior surface on a side of the opening lip 8. The hook retainer 9 has an outer face that faces away from the container 1 and an inner face that faces toward the container 1. The outer face and inner face of the hook retainer 9 both taper relative to the container 1. The outer face meets the inner face in a V-shaped point at a lower end of the hook retainer 9. The hook retainer 9 is spaced apart from the container 1 and the outer face and the inner face both taper inwardly toward the container 1 from an upper portion to a lower bottom portion.

The child-proof container also comprises a cover 2 that is removably engageable with the opening lip 8 along a flexible tapered self-engaging and self-sealing surface 7 between the cover 2 and the opening lip 8. The flexible tapered ridge faces the container 1 to form the flexible tapered self-engaging and self-sealing surface 7, the ridge is capable of mating with the opening lip 8 of the container 1 so that the ridge is capable of maintaining a seal with the lip 8 along the flexible tapered self-engaging and self-sealing surface 7 in both positions. The cover 2 is capable of moving toward the container 1 to a compressed position and away from the container, shown in FIGS. 3, 7 and 8, to a normally sealed position, shown in FIGS. 1, 4, 5 and 6. The cover 2 is connected to the container 1 by a hinged connection, which comprises a living hinge 3, on a side opposite to the hook retainer 9. The living hinge 3, which attaches the cover 2 to the container 1, is formed during the molding process.

The cover 2 further comprises a flexible tab 5A that protrudes from the cover 2 on a side of the cover 2 mating with the hook retainer 9. The flexible tab 5A has a bottom V-shaped hook 5 so that the flexible tab 5A is capable of contacting the hook retainer 9 in the normally sealed position and sliding down the hook retainer 9 as the cover 2 is pressed into the container 1 from the normally sealed position, shown in FIGS. 1, 4, 5 and 6, to the compressed position with the tab 5A flexing due to the contact with the hook retainer 9. The V-shaped hook 5 of the flexible tab 5A is capable of fitting between the hook retainer 9 and the container 1 with the V-shaped hook 5 facing outwardly toward the hook retainer 9. The V-shaped hook 5 is capable of snapping outwardly over and engaging the V-shaped bottom point or bottom edge of the hook retainer 9 in the compressed position. The cover 2 is capable of moving back to the normally sealed position, shown in FIGS. 1, 4, 5 and 6, upon engagement of the V-shaped hook 5 of the tab 5A with the V-shaped point of the hook retainer 9. The hook retainer 9 comprises a bracket with a bottom V-shaped edge and the V-shaped hook 5 of the flexible tab 5A. is capable of fitting within the bracket with the V-shaped hook snapped over and mating with the bottom V-shaped edge of the bracket 9.

Release of the cover 2 requires the cover 2 to be in the compressed position and the tab 5A to be moved so that the V-shaped hook 5 is clear of the V-shaped point of the hook retainer 9 and the cover 2 is movable away from the container 1. The cover 2 further comprises a visual indicator on an outer surface of the cover 2, adjacent to the tab 5A. The visual indicator indicates a compression point 4 to be contacted to compress the cover 2, positioned adjacent to the tab at the edge of the cap to provide a mechanical advantage over pressing down the cap in the center. The visual indicator further indicates a direction, by an arrowhead symbol 6, in which the tab 5A must be moved to release the V-shaped hook 5 of the tab from the V-shaped point of the hook retainer 9, the arrow pointing inward toward the center of the cap and container to show that the tab 5A should be pushed inwardly toward the center of the container to clear the bracket 9 after pressing down on the cap releasing the V-shaped hook 5.

All portions of the child-proof container, including the container 1, cover 2, living hinge 3, and the visual indicators 4 and 6 on the cover 2 are formed in one piece during the molding process.

Figure 3:
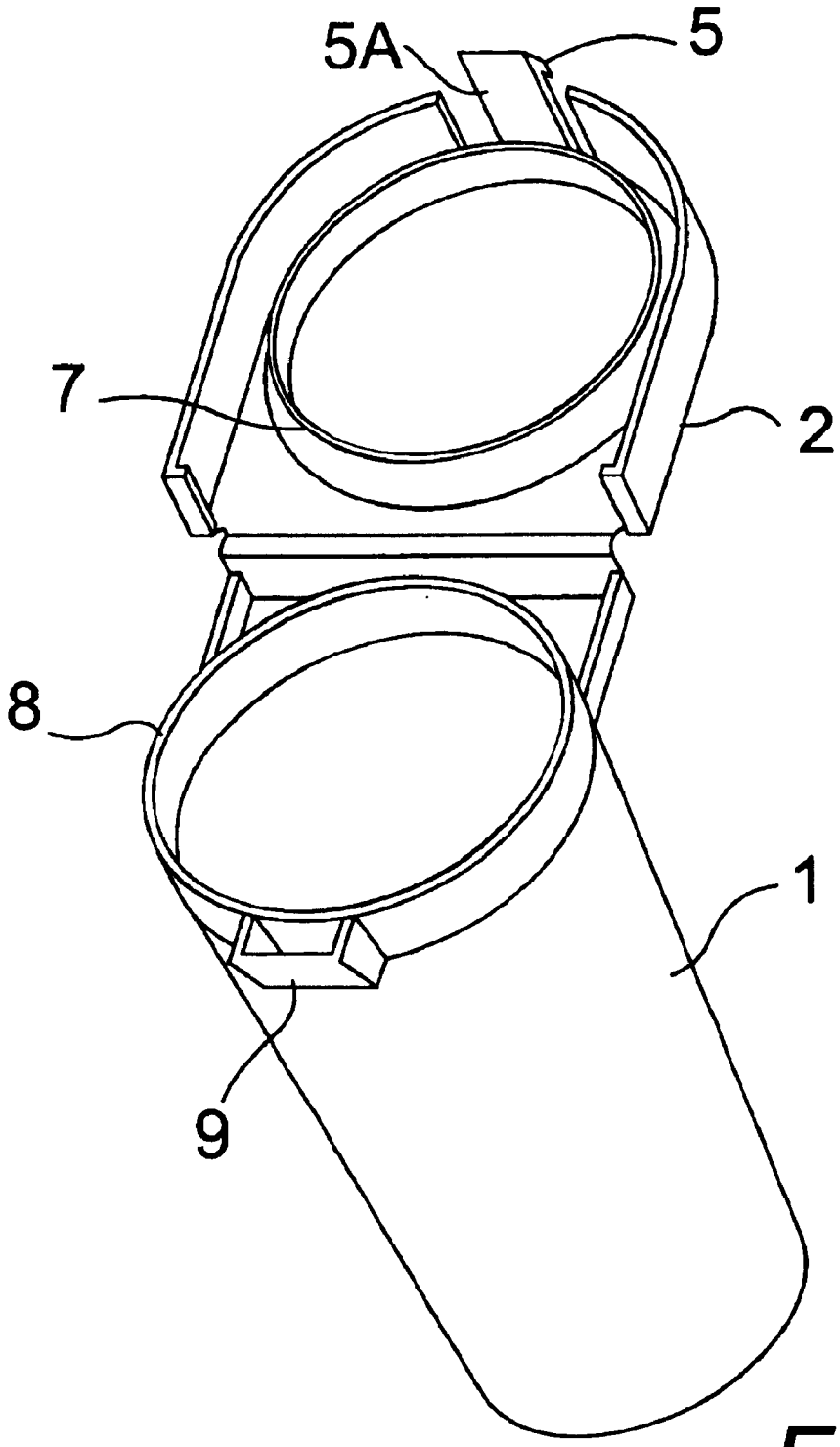
FIG. 3 is a perspective view of the invention of FIG. 1 showing the top of the bottle in an open position.
Figure 4:
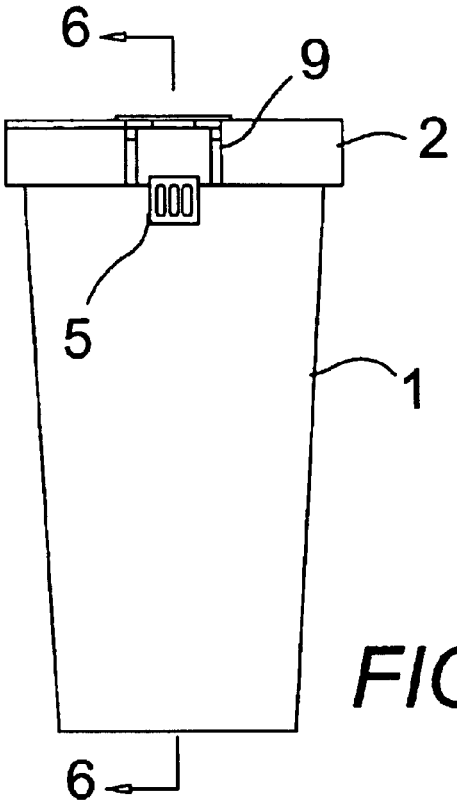
FIG. 4 is a front elevational view of the invention of FIG. 1 showing the child-proof locking tab connection from the front.
Figure 5:
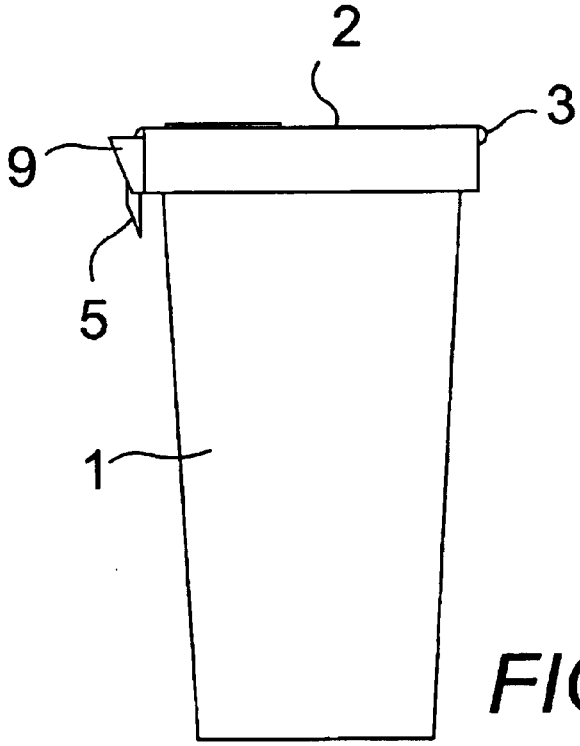
FIG. 5 is a side elevational view of the invention of FIG. 1 showing the child-proof locking tab connection from the side.
Figure 7:
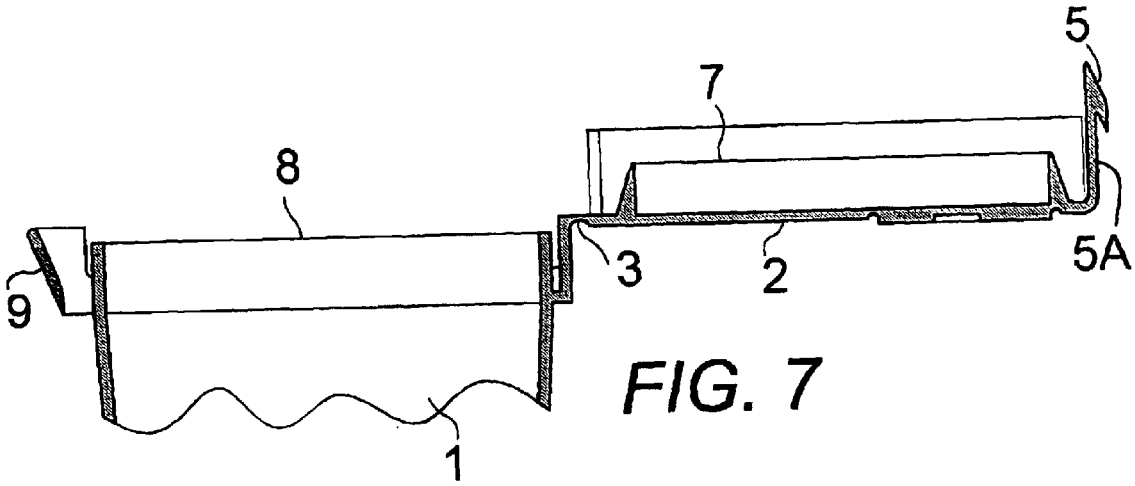
FIG. 7 is a partial cross-sectional view taken through 6—6 of FIG. 4 showing the child-proof locking tab connection from the side with the top of the bottle open.
Figure 8:
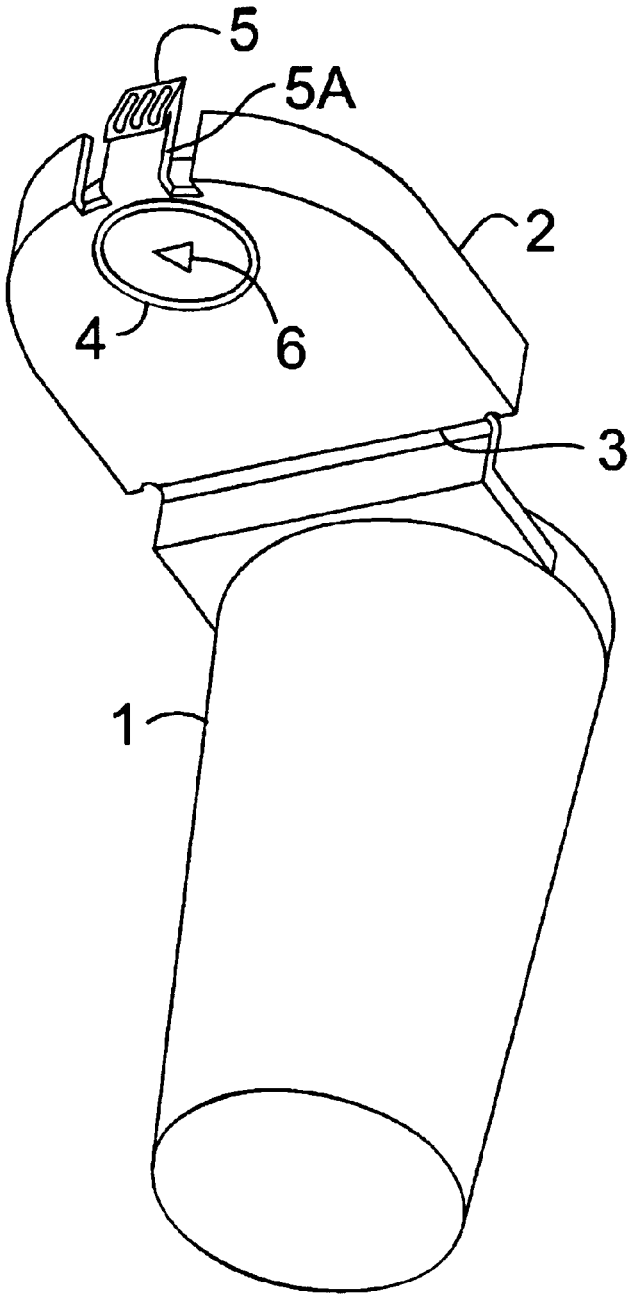
FIG. 8 is a perspective view of the invention of FIG. 1 showing the bottom and back of the bottle with the living hinge and the top of the bottle open.
Figure 9:
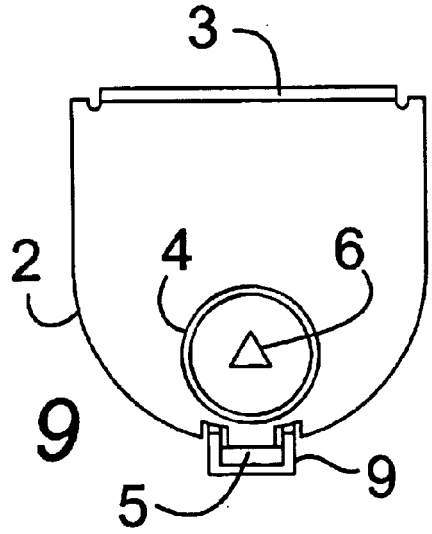
FIG. 9 is a top plan view of the invention of FIG. 1 with the top closed.

In practice, the release of the cover 2 first requires the cover 2 to be in the compressed position. The user would press downwardly on the compression point 4 indicated on the outer surface of the cover 2. Next, the user would move the flexible tab 5A in the direction indicated by the arrowhead symbol 6 on the cover 2, so that the V-shaped hook 5 is clear of the V-shaped point of the hook retainer 9. The user can then move the cover 2 away from the container 1, to an open position, as shown in FIGS. 3, 7 and 8.

Figure 6:
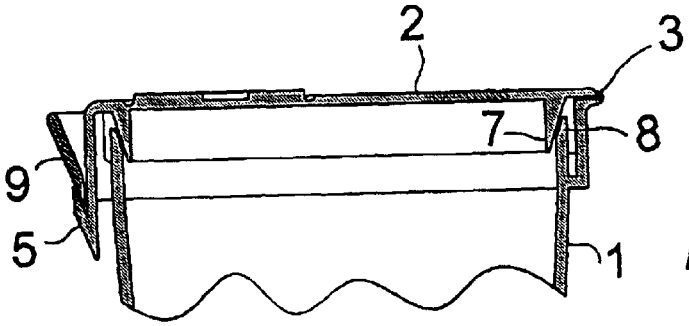
FIG. 6 is a partial cross-sectional view taken through 6—6 of FIG. 4 showing the child-proof locking tab connection from the side with the top of the bottle closed.

To reseal the container 1 the user would close the cover 2, slipping the bottom V-shaped hook 5 of the flexible tab 5A into the hook retainer surface 9, until the two 5 and 9 are self-engaged in a snap-fit as shown in FIGS. 1, 4, 5 and 6. By closing the cover 2 in this fashion the flexible tapered self-engaging and self-sealing surface 7 would seat into the upper opening lip 8, as shown in FIG. 6 for a tight seal.

The present invention closes and locks automatically and opens in a manner that is intuitive for adults who understand the opening procedure and requires no dexterity for ease of use by handicapped or aged people. Closing the cover requires pressing down the cover so it locks automatically and opening the cover requires pushing down the top of the cover at the visual indicator and then pushing in the tab, while the cover self releases from the container.

It is understood that the preceding description is given merely by way of illustration and not in limitation of the invention and that various modifications may be made thereto without departing from the spirit of the invention as claimed.

What is claimed is:

1. A child-proof container comprising:

a container having an interior storage space and an upper opening lip communicating with the interior storage space, the upper opening lip having a hook retainer connected to the opening lip on an exterior surface on a side of the opening lip, the hook retainer having an outer face facing away from the container and in inner face facing toward the container, the outer face and inner face both tapering relative to the container, the outer face meeting the inner face in a V-shaped point at a lower end of the hook retainer;

a cover removably engageable with the opening lip along a flexible tapered self-engaging self-sealing surface between the cover and the opening lip, so that the cover is capable of moving toward the container to a compressed position and away from the container to a normally sealed position, the cover connected to the container by a hinged connection on a side opposite to the hook retainer and the cover further comprising a flexible tab protruding from the cover on a side of the cover mating with the hook retainer, the flexible tab having a bottom V-shaped hook so that the flexible tab is capable of contacting the hook retainer in the normally sealed position and sliding down the hook retainer as the cover is pressed into the container from the normally sealed position to the compressed position with the tab flexing due to the contact with the hook retainer and the V-shaped hook is capable of snapping over and self-engaging the V-shaped point of the hook retainer in the compressed position, the cover being capable of moving back to the normally sealed position upon engagement of the V-shaped hook of the tab with the V-shaped point of the hook retainer, so that release of the cover requires the cover being in the compressed position and the tab being moved so that the V-shaped hook is clear of the V-shaped point and the cover is movable away from the container, the cover further comprising a visual indicator on an outer surface of the cover adjacent to the tab, the visual indicator indicating a compression point to be contacted to compress the cover and the visual indicator further indicating a direction in which the tab must be moved to release the V-shaped hook of the tab from the V-shaped point of the hook retainer, so that closing the cover requires pressing down the cover and opening the cover requires pushing down the top of the cover at the visual indicator and then pushing in the tab, while the cover self releases from the container.

2. The child-proof container of claim 1 wherein the hook retainer is spaced apart from the container and the outer face and the inner face both taper inwardly toward the container from an upper portion to a lower bottom portion and the tab is capable of fitting between the hook retainer and the container with the V-shaped hook facing outwardly toward the hook retainer.

3. The child-proof container of claim 1 wherein the cover further comprises a flexible tapered ridge facing the container to form the flexible tapered engaging surface, the ridge being capable of mating with the opening lip of the container so that the ridge is capable of maintaining a seal with the lip along the flexible tapered engaging surface in both positions.

4. The child-proof container of claim 1 wherein the container is a thin-walled container formed in one piece by a molding process and the hinged connection comprises a living hinge and the visual indicator is formed on the cover in the molding process.

* * * * *